US005224418A

United States Patent [19]

Simmons

[11] Patent Number: 5,224,418

[45] Date of Patent: * Jul. 6, 1993

[54] INK CONTAINMENT APPARATUS FOR SCREEN PRINTING FRAME ASSEMBLIES

[76] Inventor: David O. Simmons, 16609 Black Kettle Dr., Leander, Tex. 78641

[ * ] Notice: The portion of the term of this patent subsequent to Aug. 11, 2009 has been disclaimed.

[21] Appl. No.: 891,659

[22] Filed: May 29, 1992

Related U.S. Application Data

[63] Continuation-in-part of Ser. No. 800,616, Nov. 27, 1991, Pat. No. 5,136,939.

[51] Int. Cl.[5] ..... B05C 17/06

[52] U.S. Cl. ..... 101/127; 118/504; 101/127.1

[58] Field of Search ..... 101/127-128.4; 118/504, 505

[56] References Cited

U.S. PATENT DOCUMENTS

| | | | |
|---|---|---|---|
| 3,894,487 | 7/1975 | Miller | 101/127 X |
| 3,908,293 | 9/1975 | Newman | 101/127.1 X |
| 4,023,488 | 5/1977 | Zimmer | 101/127.1 |
| 4,520,727 | 6/1985 | Miller | 101/127 |

*Primary Examiner*—Edgar S. Burr
*Assistant Examiner*—Christopher A. Bennett

[57] ABSTRACT

An apparatus that contains inks and other substances of similar viscous within the useable area of a screen printing frames assembly. A structural assembly defining the enclosed area in which the ink is to be contained fits within the perimeter of the frame. Incorporated into the apparatus is a resilient sealing edge that ensures that the ink is contained within the area defined by the apparatus. Furthermore, a flexible retaining member may be incorporated into the apparatus for positive assurance that the position of the apparatus relative to the screen printing frame assembly is maintained constant. The apparatus is quickly and easily installed by positioning it on top of the frame, applying pressure on the top of two opposing sides of the structural assembly, and pressing it firmly against the screen and is disengaged by applying an upward force under one or more of the corners of the structural assembly until it separates from the screen printing frame assembly. Additionally, the profile of the apparatus does not interfere with the normal methods of securing the screen printing frame assembly to the printing press.

10 Claims, 5 Drawing Sheets

INK CONTAINMENT APPARATUS FOR SCREEN PRINTING FRAME ASSEMBLIES

This is a continuation-in-part application of Ser. No. 07/800,616, filed Nov. 27, 1991, now U.S. Pat. No. 5,136,939.

BACKGROUND OF THE INVENTION—FIELD OF THE INVENTION

This invention relates to screen printing apparatus, specifically to such apparatus which is used for containing inks and other substances of similar viscosity within the useable area of screen printing frame assemblies.

BACKGROUND OF THE INVENTION—DESCRIPTION OF THE PRIOR ART

The screen printing process involves a number of essential set-up procedures. For example, setting up a simple one-color design would include the following:

1. Creating a stencil of the imprinted image on the screen,
2. Securing the screen to a printing press,
3. Registering the stencil in relation to the substrate being printed, and
4. "Taping-off" the interior perimeter of the frame.

To create the stencil, a screen is coated with a photosensitive emulsion and allowed to dry. Once the emulsion has dried, a film positive(reverse of film negative) of the image to be imprinted is placed in intimate contact with the screen, and exposed to light in the UV spectrum. The photosensitive emulsion under the open areas of the film positive cures while the emulsion under the darkened areas of the film positive does not. The uncured emulsion is then washed from the screen using water under high pressure and the screen is allowed to dry. The resulting pattern on the screen is a stencil of the image that will be printed. The screen printing frame assembly (frame and screen) is then attached to a printing press, and aligned such that the imprinted image is printed in the desired location and orientation on the underlying substrate. Following registration, the inside perimeter of the frame is "taped-off".

Taping-off the screen consists of applying pieces of tape around the inside perimeter of the frame. The purpose of applying the tape is to seal off the interface where the screen meets the frame preventing ink from flowing out of the useable area of the screen, and correspondingly into the gap between the frame and the screen. And, since the emulsion is typically coated ½" to 1" from the edge of the screen, taping-off the screen prevents ink from flowing through the screen at any open areas around the edge of the screen where emulsion was not coated.

Failure to tape-off screens or properly tape-off screens results in the following adverse condition arising.

1. Misprints due to ink passing through the screen at unintended locations.
2. Excessive ink consumption due to ink flowing out of the useable area of the screen, and correspondingly into the gap between the screen and the frame.
3. Excessive clean-up time since ink between the screen and the frame must be flushed out using solvents.

As the term "taping-off" implies, tapes exclusively are presently being used for this application. From the multitude of tapes that are currently available, only those displaying the following characteristics are generally used for this application.

1. High Flexibility—the screen stretches during printing
2. Solvent Resistant—during printing, the adhesive and the backing are exposed to solvents in the ink
3. High Tack Adhesive—the tapes must not release from the screen during potentially long print runs.
4. Integral Construction—the adhesive must remain with the backing when removed from the screen.
5. Inexpensive—the tape must be reasonably priced since a considerable amount of tape is used on each frame and thrown away after printing is completed.

In response to the above requirements, tapes have been developed specifically for this screen printing application. The majority of these tapes are improved versions of existing tapes which provide superior solvent resistance. Tapes termed "split linered" have been developed specifically for taping-off screen printing frames. These tapes get their name from having a removeable liner on the adhesive side that has been die cut down the center of the tape width. Corresponding to the line where the liner is die cut, a crease is created in the tape backing thereby providing a fold line. The convenience of this tape is that it allows the printer to neatly and accurately affix the tape to the frame and the screen by removing one liner, positioning and affixing the tape to the screen, and then removing the other liner and affixing the other half of the tape to the frame.

While most printers use generic packaging tapes or solvent resistant tapes, use of split linered tapes is common by large volume printers since their print runs are longer, and they often have the occasion to print the same design several times before making a new stencil. As a result of the special nature of these split linered tapes, their cost is significantly higher than generic packaging tapes or solvent resistant tapes. Whereas a standard clear plastic packaging tape or solvent resistant tape cost approximately \$3.00-\$4.00 a roll, split linered tape can be as much as 4 times more for the same size roll.

Although printers are currently using a number of different types of tapes to tape-off their screens, perceiving them to be convenient because they are available through numerous sources and perform the task at hand, all tapes suffer from a number of disadvantages when used in this capacity:

1. Hazardous to the environment because they are used as a disposable product but are not biodegradable or recyclable. Not only are the tapes not biodegradable or recyclable, but neither is the ink which is on the tape when it is removed from the screen and discarded. In actuality, the inks disposed of with these tapes pose a special concern because some of them contain hazardous chemicals, and if incinerated, can form other hazardous/toxic compounds.
2. Costly due to depletion and the overhead associated with installing/removing the tape to/from the screen. When used disposably, even the most economically priced tapes contribute significantly to overhead. Equally critical is the overhead associated with installing and removing these tapes to/from the screens since the competitiveness of most printers is directly related to minimizing set-up time and maximizing run time.
3. Difficult to handle during installation and messy to handle when removing from the screen. The high tack adhesive makes the tape difficult to handle during application since it tends to aggressively stick to anything it touches. And when it is removed from the screen after printing, the printer has to contend with not only the tacky adhesive, but also with the tape being covered with ink.

4. Unsatisfactory performance over extended periods of exposure to solvent/inks. Regardless of the tape being used, over extended periods of time, the solvents in the inks will attack the adhesive on the tape and reduce their adhesion.

SUMMARY OF THE INVENTION

FIG. 8 is a perspective drawing showing my invention (referred to hereafter as apparatus) as installed in a screen printing frame assembly. As most screen printing frame assemblies are rectangular in shape, four(4) linear members 10 connected end to end with four(4) unions 18 comprise the apparatus shown.

The apparatus is installed by placing it atop the frame 40 and pushing down on two opposing linear members 10. With adequate force, the apparatus will slide down into the inside perimeter of the frame 40 until the lip 20 of each union 18 is flush with the screen 42. The lip 20 of each union 18 and the sealing flap 12 of each linear member 10 interfaces with the screen 42 providing a boundary 44 which contains ink and other substances of similar viscosity within the area defined by the apparatus.

Two of the design features of the apparatus prevent ink flow at the interface between the linear member 10 and the flange 32. The first of these is the flow path created by the length of wing 24. In relation to the viscosity of the ink used for screen printing, this length is substantially long. The second feature preventing ink flow at this location results from the upward deflection of the sealing flap 12 as a result of its contact with the screen 42. This deflection compresses the sealing flap 12 against the wing edge 22, thereby creating a seal resistant to ink flow. This seal eliminates the possibility of the interface between the linear member 10 and the flange 32 from being directly exposed to ink.

The apparatus is held in place by the normal force resulting from the compression of the flexural beam 14. The overall dimensions of the apparatus are approximately ½" greater than those of the interior of the frame 40. Therefore, when the apparatus is installed, the flexural beams 14 of each union 18 are compressed and a distributed retaining force is provided along the line of contact between the flexural beam 14 and the frame 40. To enhance the friction, a friction pad 28 (FIG. 3) made of the same elastomeric material which comprises the sealing flap 12 is affixed along the length of each flexural beam 14 at the line on contact between the flexural beam 14 and the frame 40.

Removal of the apparatus is facilitated by pulling up on any of the unions 18.

Accordingly, the invention described has the following advantages:

1. Environmentally safer than tapes because the invention is a durable product, designed for long-lasting use. Unlike tapes, this invention is a non-disposable product that will be used as a tool rather than a disposable supply item. Therefore, the ecological hazards associated with throwing away ink covered tapes will not be experienced. Although the apparatus requires cleaning, it can be cleaned in the same solvent baths that the printers are currently using to clean their squeegees and other tools.
2. Less costly method of "taping-off" screens than tapes since it is a durable, non-disposable product. The materials comprising the components of the apparatus are essentially unaffected by the solvents found in printing inks, and the solvents that printers use to clean their equipment.
3. Less costly because the installation and removal time is a fraction of that required for tapes. Installation consists of simply placing the apparatus on top of the frame and pressing it into place. Removal is facilitated by simply pulling it out of the frame. This also adds convenient since it can be installed quickly and easily before or after the frame is secured to the press.
4. Requires no maintenance other than an occasional cleaning when changing print colors or when excess ink build-up is experienced.
5. No special skills or training is required since the operation of the apparatus is relatively simple. The printers will be able to implement the apparatus into their current operation without any significant effort.
6. Less messy than tapes, since installing and removing the apparatus does not require the printer to come into contact with any ink that may be on it. Under normal conditions, only a limited portion of the apparatus will come into direct contact with the ink, and the printer is not required to handle this area during installation or removal.

Further objects and advantages of my invention will become apparent from a consideration of the ensuing drawings and descriptions of them.

Figure 1:
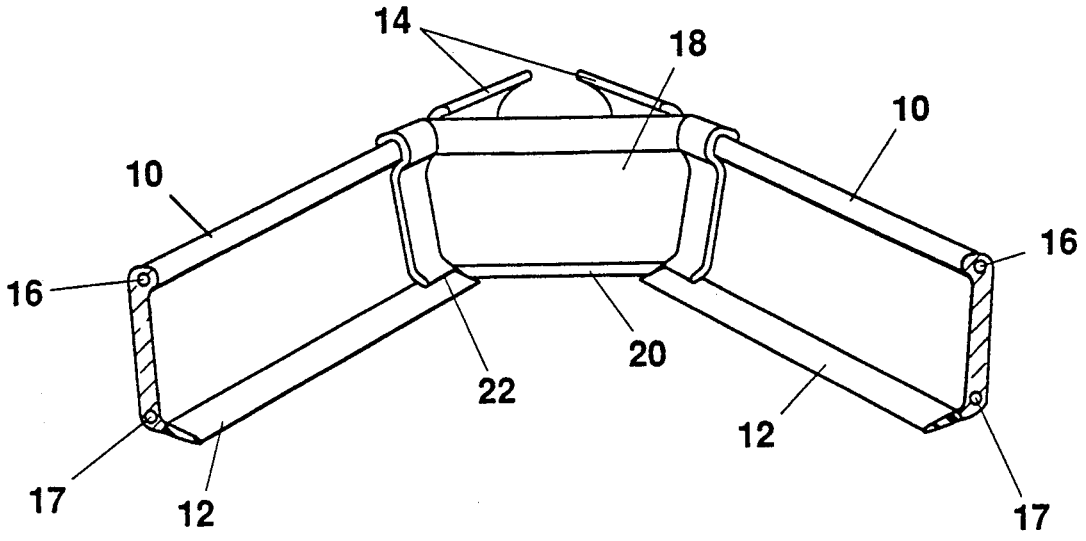
FIG. 1 is a perspective view of my invention showing its overall physical structure.

| Reference Numerals in Drawings: | | | |
|---|---|---|---|
| 10 | Linear Member | 12 | Sealing Flap |
| 14 | Flexural beam | 15 | Line of Fusion |
| 16 | Upper Hole | 17 | Lower Hole |
| 18 | Union | 20 | Lip |
| 22 | Wing Edge | 24 | Wing |
| 26 | Screw | 28 | Friction Pad |
| 30 | Frontal Surface | 32 | Flange |
| 34 | Mating Surface | 35 | Screw |
| 36 | Upper Slot | 38 | Lower Slot |
| 40 | Frame | 42 | Screen |
| 44 | Boundary | 48 | Gap |

DESCRIPTION OF THE PREFERRED EMBODIMENTS

Figure 2:
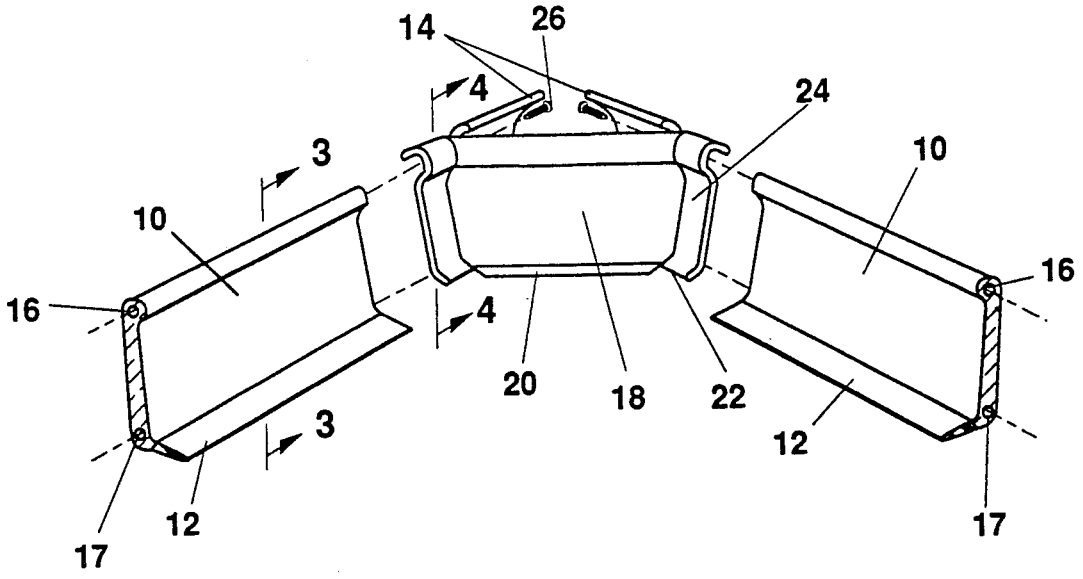
FIG. 2 is an exploded view showing the orientation of the elements of the structure in relation to each other.

A preferred embodiment of my apparatus for containing viscous substances within the useable area of a screen printing frame assembly is shown in FIGS. 1 and 2.

Linear members 10 are connected on end by a set of unions 18 thereby defining an enclosed area. Preferably, the linear member 10 has a sealing flap 12 affixed at its lower portion. The union 18 (including the integral flexural beam 14) and linear member 10 preferably consist of a flexible thermal plastic material such as polypropylene while the sealing flap 12 consists of a pliable thermal plastic rubber. To resist the harsh chemicals found in inks and cleaning solvents, the sealing flap 12 is preferably constructed of Santoprene-brand TPR; Santoprene is a trademark of Monsanto Corp., Akron, OH.

Figure 3:
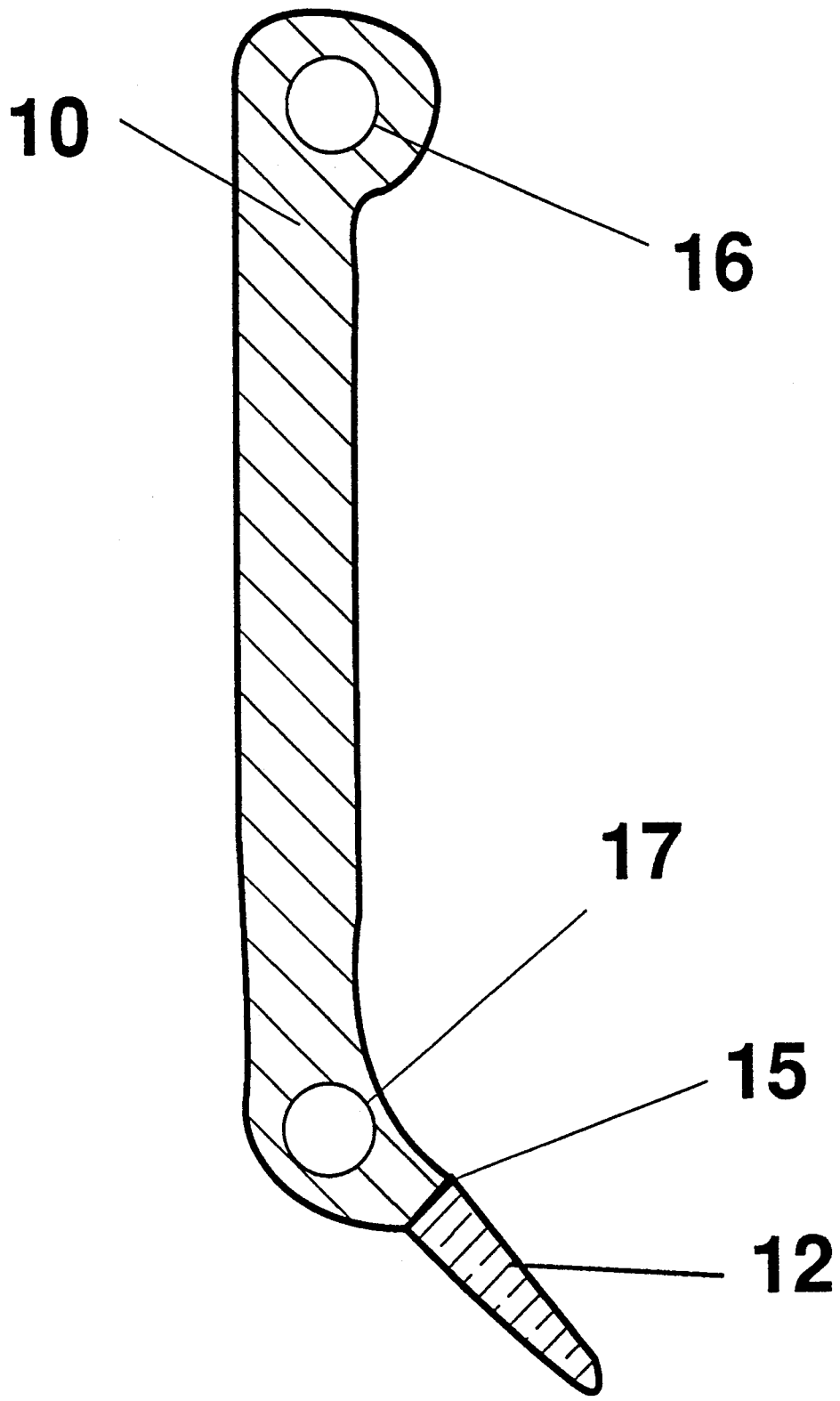
FIG. 3 is an expanded cross-sectional view of the portion indicated by the section lines 3—3 in FIG. 2.

FIG. 3 is an expanded cross-sectional view of the linear member 10 and the sealing flap 12. Preferably, the sealing flap 12 is a coextruded component of the profile comprising the linear member 10. The sealing flap 12 is molecularly bonded to the linear member 10 during the coextrusion process. The molecular bond between the sealing flap 12 and the linear member 10 occurs at the line of fusion 15. Also molecularly bonded to the linear member 10 during the coextrusion process, and consisting of the same material as the sealing flap 12, is a friction pad 28. The upper hole 16 and lower hole 17 are extruded channels into which screws 26, shown in FIG. 2, are threaded.

Figure 4:
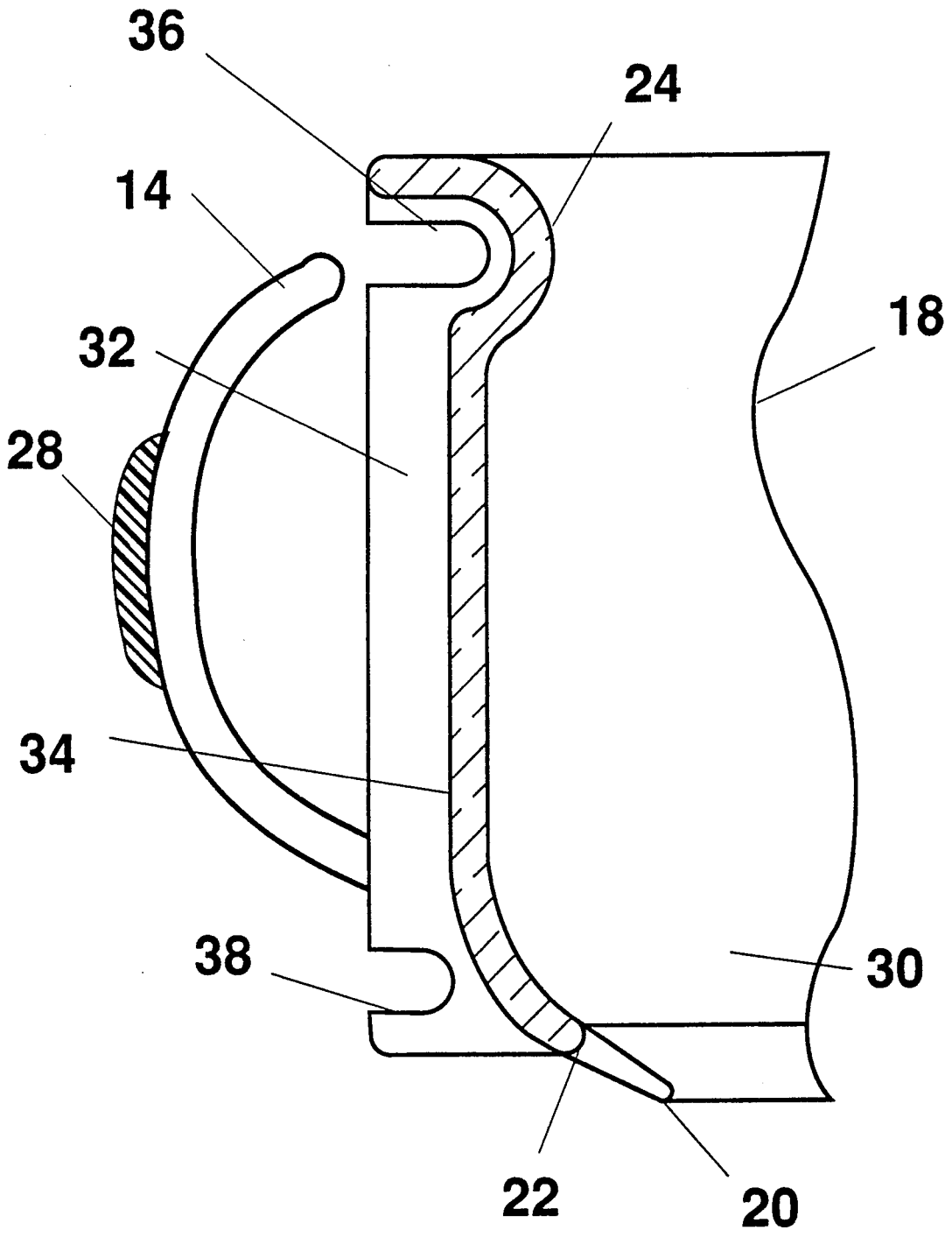
FIG. 4 is an expanded cross-sectional view of the portion indicated by the section lines 4—4 in FIG. 2.

FIG. 4 is an expanded cross-sectional view of the union 18 indicated by the section line 4—4 in FIG. 2. Preferably, the linear member 10 interfaces with the wing 24 at the mating surface 34. Screws 26 passing through the upper slot 36 and lower slot 38 thread into the upper hole 16 and the lower hole 17 of the linear member 10 securing it against the flange 32. The sealing flap 12 interfaces and conforms to the wing edge 22. The lip 20 protrudes outward and downward from the frontal surface 30 of the union 18. The ends of the sealing flap 12 butt against the sides of the lip 20. The flexural beams 14 are integral to the unions 18 and are orientated such that they lie parallel to the corresponding side of the screen printing frame.

Figure 5:
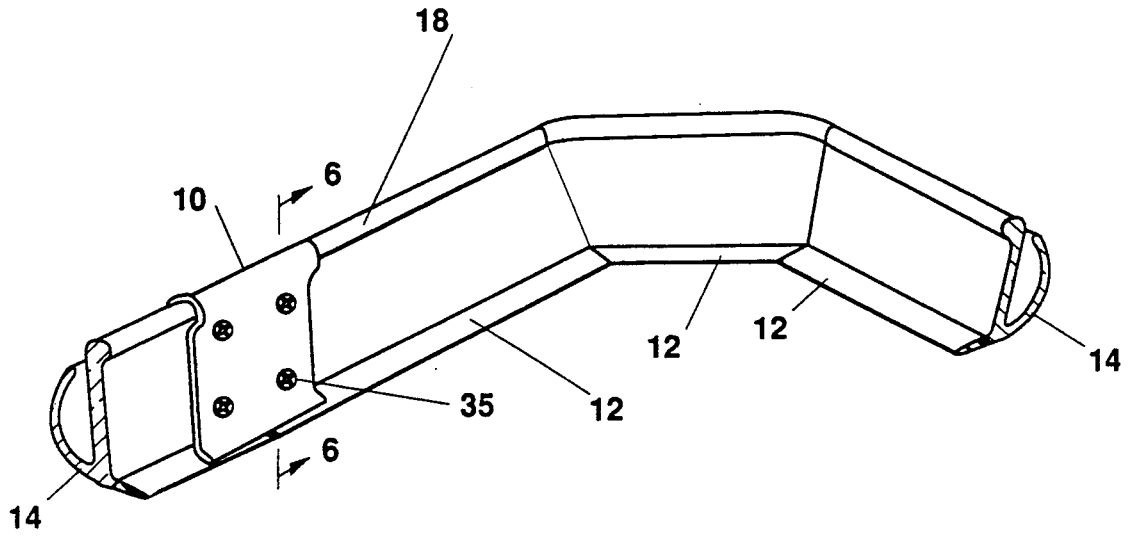
FIG. 5 is a perspective view showing an optional design of the structure of the invention.

FIG. 5 shows a variation of the preferred structure of FIG. 1 in which the wings 24 of unions 18 are substantially lengthened and linear members 10 are substantially shortened. Linear members 10 and unions 18 are attached to one another using screws 35. For a rectangular frame, four unions 18 would be attached to each other with four linear members 10. Sealing flap 12 extends continuously along the lower portion of unions 18, including the wings. 24.

Figure 6:
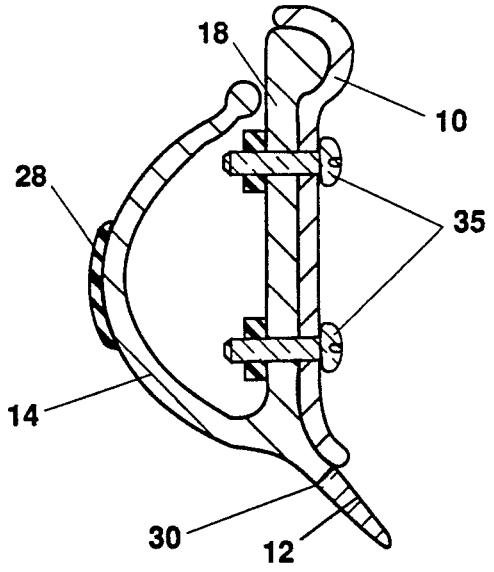
FIG. 6 is an expanded cross-sectional view of the portions indicated by section lines 6—6 in FIG. 5.

FIGS. 6 is an expanded cross sectional view of the linear member 10 and union 18 indicated by the section line 6—6 in FIG. 5. Shown is linear member 10 in front of the union 18 with flexural beam 14 integral to union 18. Preferably, screws 36 are used to fixedly couple linear members 10 to unions 18.

Figure 7:
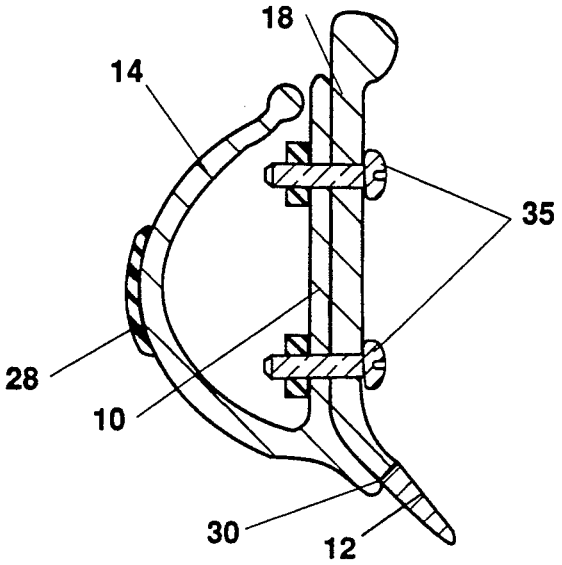
FIG. 7 is an expanded cross-sectional view of an optional design of the structure shown in FIG. 6.
Figure 8:
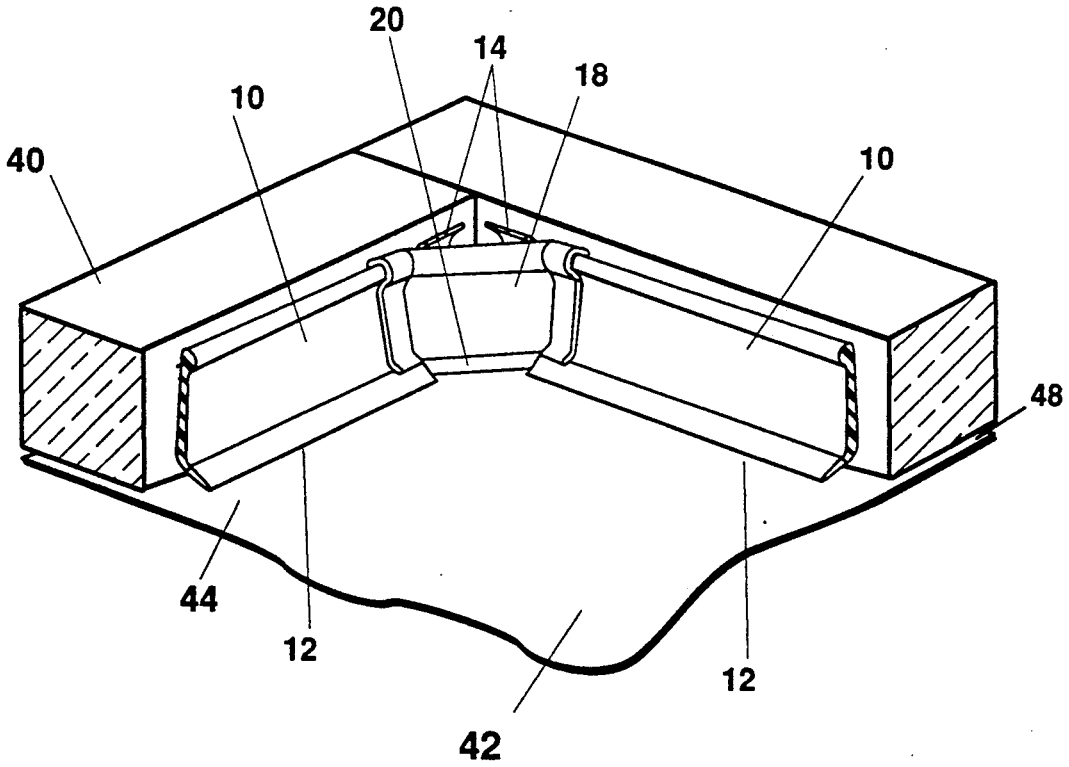
FIG. 8 is a perspective view showing the orientation of the invention as installed in a screen printing frame assembly.

FIG. 7 is an expanded cross sectional view of an optional union to linear member configuration. Shown is linear member 10 positioned in back of the union 18 with flexural beam 14 integral to linear member 10. Preferably, screws 36 are used to fixedly couple unions 18 to linear members 10.

Accordingly, the reader will recognize that the apparatus of this invention can be used to conveniently and reliably contain ink within the useable area of a screen printing frame assembly. In addition, the apparatus of this invention also provides the following advantages.

1. Environmentally safer than tapes because the apparatus of this invention is a durable product, designed for long-lasting use. Unlike tapes, this apparatus is non-disposable product that will be used as a tool rather than a disposable supply item. Therefore, the ecological hazards of throwing away ink covered tapes will not be experienced.
2. Less costly method of "taping-off" screens than using tapes since it is a durable, non-disposable product.
3. Less costly because the installation and removal time is a fraction of that required for tapes. Installation consists of simply placing the invention on top of the frame and pressing it into place. Removal is facilitated by simply pulling it out of the frame.
4. Requires no maintenance other than an occasional cleaning when changing print colors or when excess ink build-up is experienced.
5. No special skills or training is required since the operation of the apparatus is relatively simple. The printers will be able to implement the apparatus into their current operation without any significant effort.
6. Less messy than tapes, since installing and removing the apparatus does not require the printer to come into contact with any ink that may be on it.

Although the description above contains many specifics, these should not be construed as limiting the scope of the invention, but as merely providing illustrations of some of the preferred embodiments of the invention at the time this application was drafted. For example, the apparatus can have other shapes such as triangular, trapezoidal, hexagonal, etc; the material of the sealing flap could be EPDM rubber affixed using ultrasonic welding; the friction pad could be replaced longitudinal grooves; the flexural beams could be mechanically affixed to the linear member rather than integral to its geometry; etc.

Thus, the scope of the invention should be determined by the appended claims and their legal equivalents, rather than by the examples given.

I claim:

1. In combination, a screen and screen printing frame which contains a viscous substance within the utilizable area of said screen, and a structural assembly removeably received within and encompassed by said screen printing frame, said structural assembly comprising;

a plurality of linear members and a plurality of unions, said unions being fixedly coupled to the ends of said linear members, sealing means attached to said linear members and to said unions to encompass the entire perimeter of said structral assembly to inhibit the flow of the viscous substance between said structural assembly and said screen, and means enabling said structural assembly to be mounted in, maintained constant relative to, and removed from the screen printing frame as a unitary assembly, said enabling means including resilient retaining means attached to the surface of each union which faces said screen printing frame.

2. The apparatus of claim 1 wherein said sealing means is comprised of:

a) a flexible sealing flap carried by each linear member on a surface thereof for providing sealing contact with an underlying screen surface, and b) a flexible sealing lip carried by each union on a surface thereof for providing sealing contact with an underlying screen surface.

3. The apparatus of claim 1 further including wing segments attached to each union, said wing segments extending inward of and parallel to each associated linear member thereby shielding the interfaces between the linear members and unions from contact with the viscous substance.

4. The appratus of claim 1 wherein said retaining means is a compressible beam attached to each union on a surface thereof, said compressible beam being compressed when said structural assembly is mounted within a screen printing frame thereby providing a distributed retaining force acting perpendicular to the line of contact with the screen printing frame.

5. The apparatus of claim 4 further including an elastomeric friction pad affixed to each said compressible beam, said friction pad lying coincidental to the line of contact between the screen printing frame and said compressible beam.

6. In combination, a screen and screen printing frame which contains a viscous substance within the utilizable area of said screen, and a structural assembly removeably received within and encompassed by said screen printing frame, said structural assembly comprising;

a plurality of unions and a plurality of linear members, said linear members being fixedly coupled to said unions, sealing means attached to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including resilient retaining means attached to the surface of each linear member which faces said screen printing frame.

7. The apparatus of claim 6 wherein said sealing means is comprised of a lip carried by each union on a surface thereof for providing sealing contact with an underlying screen surface.

8. The apparatus of claim 6 wherein said retaining means is a compressible beam attached to each linear member on a surface thereof, said compressible beam being compressed when said structural assembly is mounted within a screen printing frame thereby providing a distributed retaining force acting perpendicular to the line of contact with the screen printing frame.

9. The apparatus of claim 8 further including an elastomeric friction pad affixed to each said compressible beam, said friction pad lying coincidental to the line of contact between the screen printing frame and said compressible beam.

10. In combination, a screen and screen printing frame which contains a viscous substance within the utilizable area of said screen, and a structural assembly removeably received within and encompassed by said screen printing frame, said structural assembly comprising;

a plurality of unions and a plurality of linear members, said linear members being fixedly coupled to said unions, sealing means attached to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including resilient retaining means attached to the surface of each union which faces said screen printing frame.

* * * * *